US008754740B2

(12) United States Patent
Pinto et al.

(10) Patent No.: US 8,754,740 B2
(45) Date of Patent: Jun. 17, 2014

(54) CIRCUIT IMPLEMENT UTILIZING ACTIVE MATERIAL ACTUATION

(75) Inventors: Nicholas William Pinto, Ferndale, MI (US); Paul W. Alexander, Ypsilanti, MI (US); Nancy L. Johnson, Northville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 88 days.

(21) Appl. No.: 12/469,556

(22) Filed: May 20, 2009

(65) Prior Publication Data

US 2010/0295653 A1 Nov. 25, 2010

(51) Int. Cl.
*H01H 71/18* (2006.01)

(52) U.S. Cl.
USPC ..... 337/126; 337/122; 337/123; 337/139; 337/140; 337/141

(58) Field of Classification Search
USPC ..... 337/122, 123, 139–141, 382, 383, 337/393–395, 126
See application file for complete search history.

(56) References Cited

U.S. PATENT DOCUMENTS

| | | | | | |
|---|---|---|---|---|---|
| 3,256,990 | A | * | 6/1966 | Lundeen | 210/138 |
| 3,594,674 | A | * | 7/1971 | Willson | 337/139 |
| 3,634,803 | A | * | 1/1972 | Willson et al. | 337/123 |
| 3,725,835 | A | * | 4/1973 | Hopkins et al. | 337/140 |
| 3,748,197 | A | * | 7/1973 | Willson et al. | 148/563 |
| 3,774,136 | A | * | 11/1973 | Zelenka | 337/382 |
| 3,967,227 | A | * | 6/1976 | Clarke et al. | 337/124 |
| 3,968,380 | A | * | 7/1976 | Jost et al. | 307/99 |
| 4,007,404 | A | * | 2/1977 | Jost et al. | 361/211 |
| 4,356,478 | A | * | 10/1982 | Muggli et al. | 340/593 |
| 4,423,401 | A | * | 12/1983 | Mueller | 337/107 |
| 4,517,543 | A | * | 5/1985 | Brubaker | 337/140 |
| 4,544,988 | A | * | 10/1985 | Hochstein | 361/211 |
| 4,551,975 | A | * | 11/1985 | Yamamoto et al. | 60/528 |
| 4,700,541 | A | * | 10/1987 | Gabriel et al. | 60/528 |
| 4,887,430 | A | * | 12/1989 | Kroll et al. | 60/527 |
| 4,975,341 | A | * | 12/1990 | Tucholski et al. | 429/62 |
| 4,992,339 | A | * | 2/1991 | Georgopoulos | 429/7 |
| 5,061,914 | A | * | 10/1991 | Busch et al. | 337/140 |
| 5,410,290 | A | * | 4/1995 | Cho | 337/140 |
| 5,825,275 | A | * | 10/1998 | Wuttig et al. | 337/139 |
| 5,920,251 | A | * | 7/1999 | Shea | 337/140 |
| 5,990,777 | A | * | 11/1999 | Whiteman, Jr. | 337/140 |
| 6,016,096 | A | * | 1/2000 | Barnes et al. | 337/123 |
| 6,236,300 | B1 | * | 5/2001 | Minners | 337/139 |
| 6,239,686 | B1 | * | 5/2001 | Eder et al. | 337/382 |
| 7,372,355 | B2 | * | 5/2008 | Agronin et al. | 337/126 |
| 7,928,826 | B1 | * | 4/2011 | Woychik et al. | 337/140 |
| 2006/0273876 | A1 | * | 12/2006 | Pachla et al. | 337/140 |

FOREIGN PATENT DOCUMENTS

| | | |
|---|---|---|
| DE | 2701884 | 7/1977 |
| DE | 3424472 | 1/1985 |
| DE | 10062704 | 7/2002 |
| DE | 202004020706 | 11/2005 |
| DE | 60208733 | 8/2006 |

* cited by examiner

*Primary Examiner* — Anatoly Vortman

(57) ABSTRACT

An electronic implement adapted for use in a circuit, and including a shape memory element, such as a shape memory alloy wire, wherein the element, when activated and/or deactivated, is operable to open, close, or otherwise modify at least one characteristic of the circuit.

10 Claims, 3 Drawing Sheets

CIRCUIT IMPLEMENT UTILIZING ACTIVE MATERIAL ACTUATION

BACKGROUND OF THE INVENTION

1. Technical Field

This disclosure generally relates to thermal fuses, relays, and other electrical components (collectively referred to herein as "circuit" or "electronic" implements) adapted for use in and modifying at least one characteristic of a circuit; and more particularly, to a circuit implement that utilizes shape memory material actuation to effect functionality.

2. Background Art

Fuses, relays, and variable resistors, as well as other components have long been implemented in electronics to improve the safety and capabilities of circuits. For example, thermal fuses are often used to protect vital or expensive components, people, and environments from current and thermal overloading; and relays are often used to enable a low-energy input device such as the ignition in a vehicle to actuate a high-energy device such as a starter motor.

With respect to fuses, it is appreciated that traditional fuses offer permanent interruptions to devices that may otherwise require only temporary protection. Moreover, these fuses are increasingly difficult to replace as devices become increasingly complex and congested. As a result, manually and autonomously resettable fuses have been developed, including, for example, polymeric positive temperature coefficient (PTC) These fuses re-orient the polymer chains from crystalline to amorphous, reducing current flow to a nearly "open state," when subjected to excessive current. Concernedly, however, PTC fuses never actually open the circuit, and because they create resistance on a molecular level, their reset functionality may be difficult to control.

With respect to relays and variable resistors, a simple, inexpensive, and reliable construction is often desirous and/or beneficial. However, most relays known in the art are electromechanical, and often constructed with a complex metal coil and armature that is susceptible to getting stuck after repetitive use. In addition, the application and removal of the induction current to the coil often requires the use of additional electrical components to dissipate unwanted or damaging energy influx. Other relays known in the art eliminate the need for electromechanical devices, but incorporate numerous electrical components, increasing cost. They are also prone to false firing and shorting out.

BRIEF SUMMARY

In response to the afore-mentioned concerns, the invention presents a shape memory material based thermal implement. As such, the invention is useful for completely opening or otherwise modifying a circuit and enabling precise control of the reset functionality. Thus, the invention more accurately protects the circuit and its environment without reducing circuit functionality, and simultaneously reduces or eliminates fuse replacement costs. The invention may also be used in low-temperature applications for which current thermal fuse technology is not suitable. The invention can be adapted for applications that require different current, voltage, or temperature rating simply by varying the composition, diameter, or length of the shape memory material, or by altering the operating stress.

Generally, the invention concerns an implement adapted to protect or modify a circuit, and including an active material element. The element is formed of a shape memory material operable to undergo a reversible change when exposed to an activation signal. The implement is configured such that the change is operable to move a first contact relative to a second such that the motion opens, closes or varies the output of at least a portion of the circuit. For example, in one embodiment, the invention uses the shape memory properties of shape memory alloy (SMA) or other shape memory material to create a relay or variable resistor that eliminates the need for electromagnetic control electronics.

Other aspects and advantages of the present invention will be apparent from the following detailed description of the preferred embodiment(s) and the accompanying drawing figures.

BRIEF DESCRIPTION OF THE SEVERAL VIEWS OF THE DRAWING

A preferred embodiment of the invention is described in detail below with references to the attached drawing figures, wherein.

DETAILED DESCRIPTION

Figure 1B:
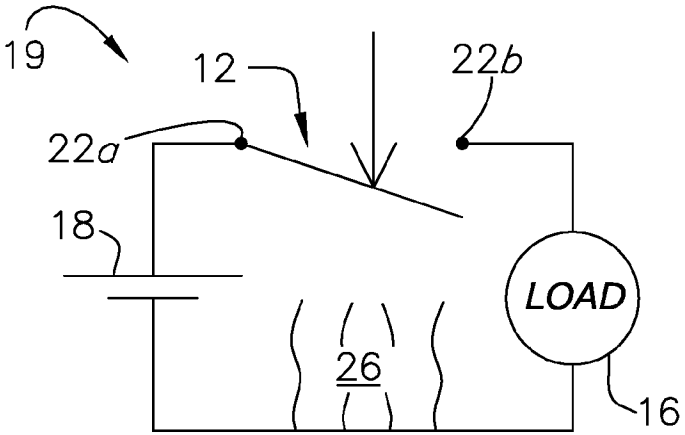
FIG. 1*b* is a schematic of a circuit incorporating the use of a relay wherein the relay is connected in line with a power source and load, such that an activation signal opens or closes the circuit encompassing the load, in accordance with a preferred embodiment of the invention.

The following description of the preferred embodiments is merely exemplary in nature and is in no way intended to limit the invention, its application, or uses. The present invention may find utility in a wide range of applications; including, for example, in protection of circuits and electrical components (FIGS. 1*a* and 2*a,b*), and control, activation, and logic of circuits (FIGS. 1*b,c* and 3*a,b*). That is to say, the invention is applicable wherever the advantages and benefits of using circuit protection and manipulation is desired.

In general, the invention concerns a shape memory element configured to move a contact in relation to another contact so as to open, close, or otherwise vary at least one characteristic of a circuit. The element employs active material actuation to facilitate application and/or improve function.

Suitable active materials for use with the present invention include but are not limited to shape memory alloys, ferromagnetic shape memory alloys, and other active materials, such as electroactive polymers (EAP), that can function as actuators under fibrous configurations and atmospheric conditions. These types of active materials have the ability to remember their original shape and/or elastic modulus, which can subsequently be recalled by applying an external stimulus. As such, deformation from the original shape is a temporary condition. In this manner, an element composed of these materials can change to the trained shape in response to either the application or removal (depending on the material and the form in which it is used) of an activation signal. Other active materials compatible with the present invention include shape memory polymer, piezoelectric composites, magnetorheological elastomers, and electrorheological elastomers.

More particularly, shape memory alloys (SMA's) generally refer to a group of metallic materials that demonstrate the ability to return to some previously defined shape or size when subjected to an appropriate thermal stimulus. Shape memory alloys are capable of undergoing phase transitions in which their yield strength, stiffness, dimension and/or shape are altered as a function of temperature. The term "yield strength" refers to the stress at which a material exhibits a specified deviation from proportionality of stress and strain. Generally, in the low temperature, or martensite phase, shape memory alloys can be pseudo-plastically deformed and upon exposure to some higher temperature will transform to an austenite phase, or parent phase, returning to their shape prior to the deformation. Materials that exhibit this shape memory effect only upon heating are referred to as having one-way shape memory. Those materials that also exhibit shape memory upon re-cooling are referred to as having two-way shape memory behavior.

Shape memory alloys exist in several different temperature-dependent phases. The most commonly utilized of these phases are the so-called Martensite and Austenite phases discussed above. In the following discussion, the martensite phase generally refers to the more deformable, lower temperature phase whereas the austenite phase generally refers to the more rigid, higher temperature phase. When the shape memory alloy is in the martensite phase and is heated, it begins to change into the austenite phase. The temperature at which this phenomenon starts is often referred to as austenite start temperature (As). The temperature at which this phenomenon is complete is called the austenite finish temperature ($A_f$).

When the shape memory alloy is in the austenite phase and is cooled, it begins to change into the martensite phase, and the temperature at which this phenomenon starts is referred to as the martensite start temperature ($M_s$). The temperature at which austenite finishes transforming to martensite is called the martensite finish temperature ($M_f$).

Shape memory alloys can exhibit a one-way shape memory effect, an intrinsic two-way effect, or an extrinsic two-way shape memory effect depending on the alloy composition and processing history. Annealed shape memory alloys typically only exhibit the one-way shape memory effect. Sufficient heating subsequent to low-temperature deformation of the shape memory material will induce the martensite to austenite type transition, and the material will recover the original, annealed shape. Hence, one-way shape memory effects are only observed upon heating. Active materials comprising shape memory alloy compositions that exhibit one-way memory effects do not automatically reform, and will likely require an external mechanical force to reform the shape.

Intrinsic and extrinsic two-way shape memory materials are characterized by a shape transition both upon heating from the martensite phase to the austenite phase, as well as an additional shape transition upon cooling from the austenite phase back to the martensite phase. Active materials that exhibit an intrinsic shape memory effect are fabricated from a shape memory alloy composition that will cause the active materials to automatically reform themselves as a result of the above noted phase transformations. Intrinsic two-way shape memory behavior must be induced in the shape memory material through processing. Such procedures include extreme deformation of the material while in the martensite phase, heating-cooling under constraint or load, or surface modification such as laser annealing, polishing, or shot-peening. Once the material has been trained to exhibit the two-way shape memory effect, the shape change between the low and high temperature states is generally reversible and persists through a high number of thermal cycles. In contrast, active materials that exhibit the extrinsic two-way shape memory effects are composite or multi-component materials that combine a shape memory alloy composition that exhibits a one-way effect with another element that provides a restoring force to reform the original shape.

The temperature at which the shape memory alloy remembers its high temperature form when heated can be adjusted by slight changes in the composition of the alloy and through heat treatment. In nickel-titanium shape memory alloys, for instance, it can be changed from above about 100° C. to below about −100° C. The shape recovery process occurs over a range of just a few degrees and the start or finish of the transformation can be controlled to within a degree or two depending on the desired application and alloy composition. The mechanical properties of the shape memory alloy vary greatly over the temperature range spanning their transformation, typically providing the system with shape memory effects, superelastic effects, and high damping capacity.

Suitable shape memory alloy materials include, without limitation, nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-platinum based alloys, iron-palladium based alloys, and the like. The alloys can be binary, ternary, or any higher order so long as the alloy composition exhibits a shape memory effect, e.g., change in shape orientation, damping capacity, and the like.

It is appreciated that thermally induced SMA phase changes are one-way so that a biasing force return mechanism (such as a spring) would be required to return the SMA to its starting configuration once the applied field is removed. Joule heating can be used to make the entire system electronically controllable.

It is appreciated that most nickel titanium based alloys transform over a relatively small temperature range. As the stress increases, so does the transformation temperature for many alloys. In order to increase the temperature sensitivity operational range, it may be desirable to influence the transformation temperature during the transformation, by preferably countering the transformation with a tuned spring load. As the alloy begins to transform, it would extend the spring, increasing the load and subsequent stress on the alloy. This different stress would cause the alloy to take on different transformation temperatures, thus causing the alloy to respond to a wider range of temperature fluctuations.

As previously mentioned, electroactive polymers may be used in lieu of SMA. This type of active material includes those polymeric materials that exhibit piezoelectric, pyroelectric, or electrostrictive properties in response to electrical or mechanical fields. An example is an electrostrictive-grafted elastomer with a piezoelectric poly(vinylidene fluoride-trifluoro-ethylene) copolymer. This combination has the ability to produce a varied amount of ferroelectric-electrostrictive, molecular composite systems. These may be operated as a piezoelectric sensor or even an electrostrictive actuator.

Materials suitable for use as an electroactive polymer may include any substantially insulating polymer or rubber (or combination thereof) that deforms in response to an electrostatic force or whose deformation results in a change in electric field. Exemplary materials suitable for use as a pre-strained polymer include silicone elastomers, acrylic elastomers, polyurethanes, thermoplastic elastomers, copolymers comprising PVDF, pressure-sensitive adhesives, fluoroelastomers, polymers comprising silicone and acrylic moieties, and the like. Polymers comprising silicone and acrylic moieties may include copolymers comprising silicone and acrylic moieties, polymer blends comprising a silicone elastomer and an acrylic elastomer, for example.

Figure 1A:
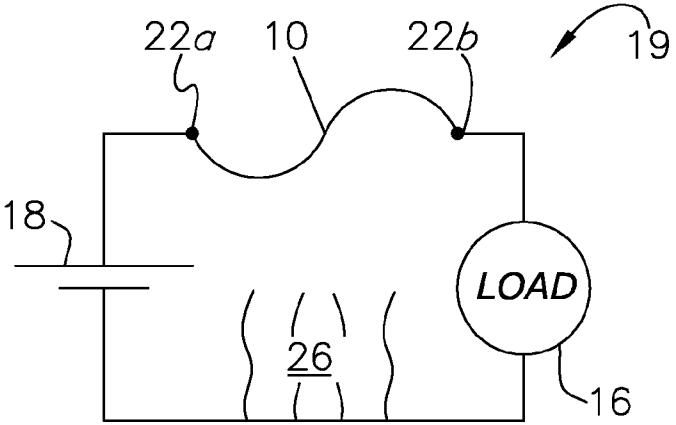
FIG. 1*a* is a schematic of a circuit utilizing a resettable fuse wherein the fuse is connected in line with a power source and load, so as to protect the circuit from electrical and thermal damage, in accordance with a preferred embodiment of the invention.
Figure 1C:
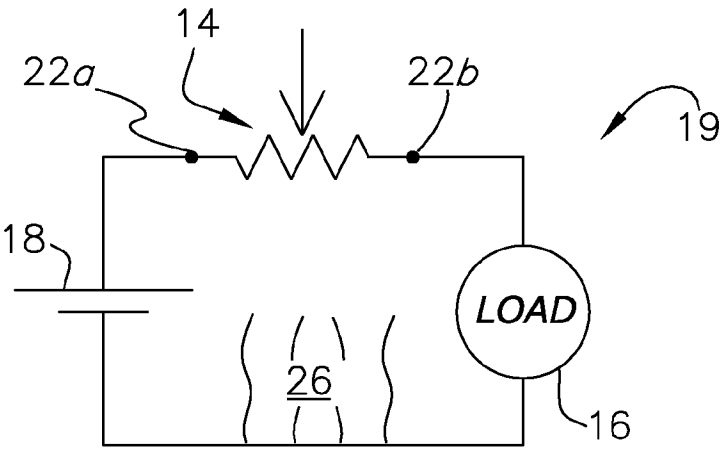
FIG. 1*c* is a schematic of a circuit incorporating the use of a variable output resistor wherein the resistor is connected in line with a power source and load, such that an activation signal varies the resistance in the circuit, in accordance with a preferred embodiment of the invention.

Turning to FIGS. 1*a-c*, an electronic implement such as a resettable fuse 10 (FIG. 1*a*), relay 12 (FIG. 1*b*), or variable output resistor 14 (FIG. 1*c*) is used in conjunction with a load 16 and power source 18 to complete a circuit 19. With respect to the fuse 10, the load 16 is effectively protected from harmful heat or current, and in the cases of the relay 12 and variable output resistor 14, the current through the load is effectively controlled by the relay 12 and variable output resistor 14.

Figure 2B:
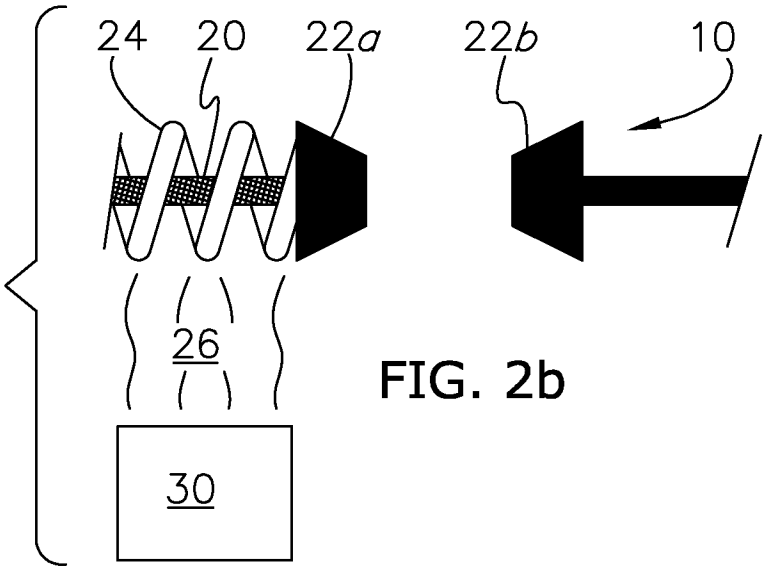
FIG. 2*b* is an elevation of the resettable fuse shown in FIG. 2*a*, in an open contact position, wherein the shape memory element presents a second geometry, the circuit is opened as a result thereof, and the spring is loaded, in accordance with a preferred embodiment of the invention.
Figure 2A:
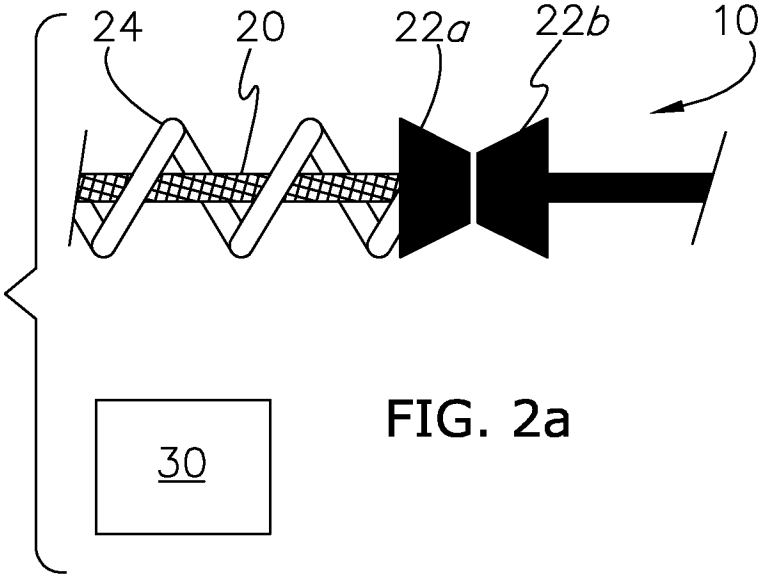
FIG. 2*a* is an elevation of a resettable fuse in a closed contact position, wherein a shape memory element is in an initial geometry, current is able to pass through the fuse, and a return spring is unloaded, in accordance with a preferred embodiment of the invention.

As shown in the illustrated embodiments, each implement comprises a shape memory element 20 configured to modify (e.g., toggle, vary, etc.) the implement between a plurality of achievable configurations (e.g., positions, conditions, etc.). In FIGS. 2*a,b*, with respect to the resettable fuse 10, for example, the element 20 is operable to disconnect a first contact 22*a* from a second 22*b* when the element 20 is subjected to a suitable activation signal 26. If the application requires an automatic return mechanism (e.g., only one-way shape memory is provided), it is preferable that a return spring 24 be attached to the movable contact 22*a*, and operable to return the contact 22*a* once the signal 26 is removed. In FIGS. 2*a,b*, the spring 24 is shown concentrically aligned with the shape memory element 20; however, it is certainly appreciated that other geometric forms such as a leaf spring, or an electrically and thermally isolating extension spring interconnecting the contacts 22*a,b* may be utilized. FIG. 2*b* shows the shape memory element 20 activated, the return spring 24 loaded (i.e., storing energy), and the contacts 22*a,b* disconnected.

In a preferred embodiment, the shape memory element 20 is composed of an SMA wire, wherein the term "wire" is used in a non-limiting sense and incorporates other geometric forms, such as cables, braids, bundles, strips, etc. In this configuration, the signal 26 is a thermal activation signal that may be generated directly through Joule heating designed to be reached when the current being carried by the circuit 19 exceeds a threshold amperage, or indirectly by an external source (e.g., a vehicle engine, cooling system, etc.) 30 (FIGS. 2*a,b*). As previously mentioned, however, the element 20 may also comprise FSMA or EAP, wherein the signal 26 is a magnetic field or electric current respectively. The inventive fuse 10 is particularly useful for applications wherein thermal energy is produced directly or as a by-product, including a coffee pot, battery charger, or with respect to a vehicle, a charging system, braking module, electric motor, battery charger.

Figure 3B:
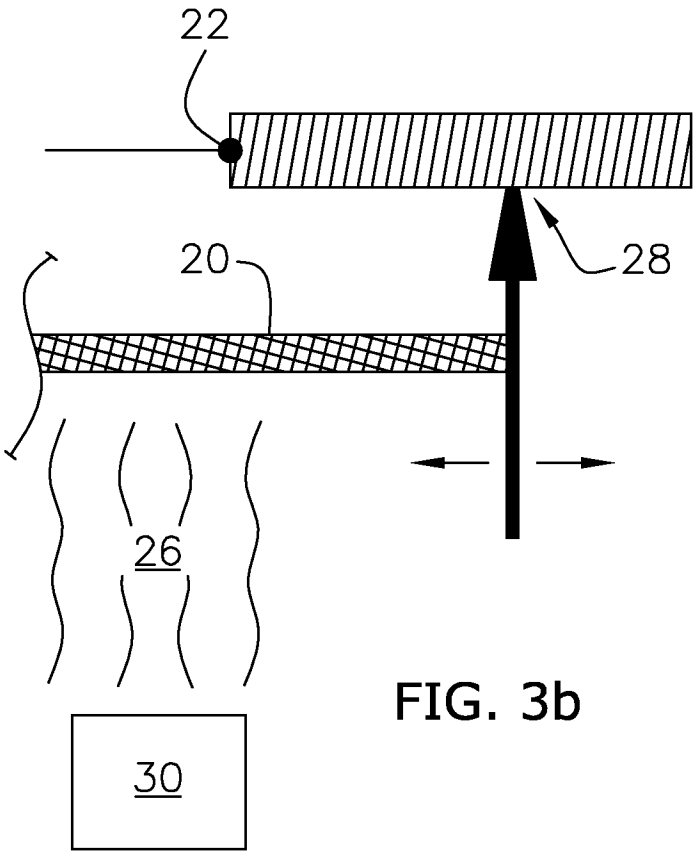
FIG. 3*b* is an elevation of a variable output resistor including a shape memory element drivenly coupled to a sliding contact, the element can slide the contact, in accordance with a preferred embodiment of the invention.
Figure 3A:
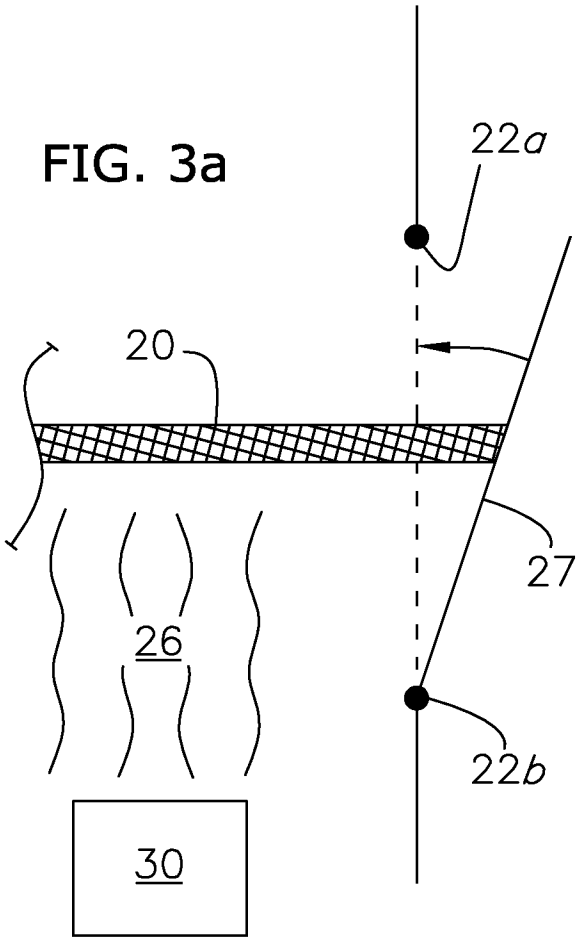
FIG. 3*a* is an elevation of a relay utilizing a shape memory element wherein the shape memory element is depicted in a non-activated geometry, such that the relative positions of the contacts causes the circuit to be open, and upon receiving an activation signal, the shape memory element closes the circuit along the dotted line, in accordance with a preferred embodiment of the invention.

In FIG. 3*a*, a shape memory element 20 is adapted for use in a relay 12. The shape memory element 20 is drivenly connected to a toggle 27, and operable to selectively cause a first contact 22*a* to move relative to another 22*b*, when the element 20 is subjected to an external signal 26. If the application requires, the orientation of the contacts 22 can be changed so that the contacts 22 separate when the element 20 is activated. It is appreciated that the element 20 may be drivenly connected to a plurality of toggles 27, so as to simultaneously control a plurality of circuits 19. Again, the shape memory element 20 may present an SMA wire, wherein the signal 26 is a thermal activation signal. In this configuration, the invention is particularly applicable to activate a circuit dependent upon temperature actuation, such as an automotive cooling fan, a micro-processor cooling fan, or a liquid-cooled system.

In FIG. 3*b*, the element 20 is used in a variable output resister 14 (e.g., potentiometer, rheostat, thermistor, etc.). The element 20 is drivenly coupled to and operable to move a sliding contact 28, when the element 20 is subjected an external signal 26. That is to say, the element 20 is configured to pull and/or push (where two-way shape memory is provided) the sliding contact 28, so as to increase or decrease electrical resistance between the contacts 22,28. Again, the element 20 preferably presents a shape memory wire. Applications in which the desire to activate a circuit is dependent upon temperature, such as an automotive cooling fan, are preferred uses.

In the variable-output embodiment, the shape memory alloy is preferably connected through a crimp, solder, or bolt (not shown) to the end of a linear spring loaded potentiometer (also not shown). If a rotary potentiometer is used, a straight piece of toothed plastic, or other non-conductive material, can be attached to the alloy and a mating rotary gear attached to the shaft of the rotary potentiometer such that when the alloy actuates, the gear is turned, causing the sliding contact in the potentiometer to rotate, resulting in a change of current going to a load in the circuit, in a preferred embodiment. The shape memory alloy preferably has a spring return or switch to reset after an event.

This invention has been described with reference to exemplary embodiments; it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out this invention, but that the invention will include all embodiments falling within the scope of the appended claims.

The terms "a" and "an" herein do not denote a limitation of quantity, but rather denote the presence of at least one of the referenced item. The suffix "(s)" as used herein is intended to include both the singular and the plural of the term that it modifies, thereby including one or more of that term. Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

What is claimed is:

1. A stand-alone electronic implement adapted for use in a circuit conveying an electric current, having no power source external to the circuit, and for autonomously modifying the circuit, the implement adapted to convey a full electrical current of the circuit, the implement comprising:

at least one active material element selectively operable to undergo a reversible change exclusively in response to Joule heating of the at least one active material element to a first threshold temperature to activate the at least one active material;

a tuned spring load to oppose the reversible change wherein the first threshold temperature is adjustable by adjusting the spring load; and a first electrical contact attached to the at least one active material element, in electrical communication with the at least one active material element, and selectively connectable with a second electrical contact to close the circuit in a first position or open the circuit in a second position;

wherein:

the Joule heating is caused exclusively by the same electric current passing through the circuit and the at least one active material element;

the Joule heating causes the at least one active material element to rise to the first threshold temperature when the current passing through the at least one active material element is greater than a threshold current;

the at least one active material element is configured such that the reversible change opens or closes the circuit; and the at least one active material element has a two-way shape memory, so as to be operable to move the first contact back to the first position when the change is reversed by cooling to a second threshold temperature.

2. The implement of claim 1, wherein the at least one active material is selected from the group consisting of ferromagnetic shape memory alloy, shape memory polymer, piezoelectric composites, electroactive polymers, magnetorheological elastomers, and electrorheological elastomers.

3. The implement of claim 1, wherein the at least one active material element is a shape memory alloy wire.

4. The implement of claim 1, wherein:

the at least one active material element presents an initial geometry;

the reversible change is operable to modify at least one dimension of the initial geometry, so as to result in a second geometry; and the modification to the second geometry causes the first contact to move from the first position relative to the second contact, so as to open the circuit.

5. The implement of claim 4, further comprising:

a return mechanism drivenly coupled to the first contact, and operable to move the first contact back to the first position when the change is reversed.

6. The implement of claim 5, wherein the element is an SMA (Shape Memory Alloy) wire, and the mechanism is a compression spring concentrically aligned with the SMA wire.

7. The implement of claim 1, wherein the implement is a fuse, and when the current exceeds a threshold amperage, and the active material element opens the circuit.

8. The implement of claim 1, wherein the implement is a relay, the element is communicatively coupled to a toggle composing the circuit, and the change is operable to cause the toggle to switch, so as to open or closed the circuit.

9. The implement of claim 8, wherein the circuit is a control circuit for an automotive cooling fan, a micro-processor cooling fan, or a liquid-cooled system.

10. The implement of claim 1, wherein a functional relationship between the electric current passing through the at least one active material element and a rate of the Joule heating is responsive to the diameter or length of the at least one active material element.

* * * * *